US010494168B2

(12) United States Patent
Bray et al.

(10) Patent No.: US 10,494,168 B2
(45) Date of Patent: Dec. 3, 2019

(54) WRAPPER FOR TOBACCO INDUSTRY PRODUCTS

(71) Applicant: British American Tobacco (Investments) Limited, London (GB)

(72) Inventors: Andrew Jonathan Bray, London (GB); Jeonghwan Park, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 229 days.

(21) Appl. No.: 15/533,111

(22) PCT Filed: Nov. 27, 2015

(86) PCT No.: PCT/GB2015/053637
§ 371 (c)(1),
(2) Date: Jun. 5, 2017

(87) PCT Pub. No.: WO2016/087826
PCT Pub. Date: Jun. 9, 2016

(65) Prior Publication Data

US 2018/0162631 A1 Jun. 14, 2018

(30) Foreign Application Priority Data

Dec. 5, 2014 (GB) ..... 1421700.4

(51) Int. Cl.
*B65D 85/10* (2006.01)
*B65D 75/58* (2006.01)

(52) U.S. Cl.
CPC ..... *B65D 85/1018* (2013.01); *B65D 75/5838* (2013.01); *B65D 85/1045* (2013.01); *B65D 2575/586* (2013.01)

(58) Field of Classification Search
CPC ..... B65D 85/1045; B65D 85/1063; B65D 85/1072; B65D 2575/28; B65D 5/54; B65D 5/5425; B65D 5/606; B65D 75/5838
(Continued)

(56) References Cited

U.S. PATENT DOCUMENTS 3,948,389 A * 4/1976 Molins ..... B65D 77/02 206/245
3,980,224 A * 9/1976 Yasuda ..... B65D 5/543 229/205
(Continued)

FOREIGN PATENT DOCUMENTS

DE 102011119344 A1 4/2013
EP 2599734 A1 6/2013
(Continued)

OTHER PUBLICATIONS

Response to the Written Opinion of the International Preliminary Examining Authority for corresponding application PCT/GB2015/053637 filed Nov. 27, 2015; Report dated Dec. 15, 2016.
(Continued)

*Primary Examiner* — Brian D Nash
(74) *Attorney, Agent, or Firm* — Cantor Colburn LLP

(57) ABSTRACT

A wrapper for a group of tobacco industry products is disclosed. The wrapper has a barrier material arranged to extend over an edge of a bundle after the barrier material is wrapped around a group of tobacco industry products to form the bundle. A tab is arranged such that pulling the tab forms an extraction opening that extends over the edge of the bundle. Wherein, prior to pulling the tab for the first time, at least a part of the barrier material is unbroken across the edge.

22 Claims, 13 Drawing Sheets

(58) Field of Classification Search
USPC ..... 229/87.13, 904.1, 909
See application file for complete search history.

(56) References Cited

U.S. PATENT DOCUMENTS

| | | | | | |
|---|---|---|---|---|---|
| 3,999,655 | A * | 12/1976 | Molins | B65D 75/68 | 206/259 |
| 4,303,155 | A | 12/1981 | Focke | | |
| 4,386,705 | A * | 6/1983 | Meuller | B65D 5/546 | 229/205 |
| 4,789,060 | A * | 12/1988 | Focke | B65D 85/1045 | 206/264 |
| 4,807,745 | A * | 2/1989 | Langley | B32B 27/40 | 206/245 |
| 5,160,024 | A * | 11/1992 | Evers | B65D 5/4233 | 206/264 |
| 5,427,235 | A * | 6/1995 | Powell | B32B 27/08 | 206/245 |
| 5,511,664 | A * | 4/1996 | Aramaki | B65D 75/5833 | 206/387.1 |
| 6,000,539 | A * | 12/1999 | Stewart-Cox | B65D 85/1045 | 206/264 |
| 6,164,444 | A * | 12/2000 | Bray | B65D 75/5838 | 206/268 |
| 7,290,652 | B2 * | 11/2007 | Rath | B65D 75/5827 | 206/242 |
| 7,717,260 | B2 * | 5/2010 | Buse | B65D 85/1045 | 206/242 |
| 7,877,963 | B2 * | 2/2011 | Messing | B65B 19/24 | 53/412 |
| 8,118,161 | B2 * | 2/2012 | Guerrera | B65D 77/003 | 206/274 |
| 8,123,030 | B2 * | 2/2012 | Hein | B65B 19/20 | 206/273 |
| 8,276,750 | B2 * | 10/2012 | Biondi | B65D 77/02 | 206/259 |
| 8,365,978 | B2 * | 2/2013 | Yoshimura | B65D 5/5425 | 206/264 |
| 9,533,821 | B2 * | 1/2017 | Buse | B65B 19/025 | |
| 9,566,605 | B2 * | 2/2017 | Sebastian | B05D 1/007 | |
| 9,788,575 | B2 * | 10/2017 | Buse | B65B 19/20 | |
| 9,790,020 | B1 * | 10/2017 | Sebastian | B65D 85/1081 | |
| 9,950,859 | B2 * | 4/2018 | Steinkamp | B65D 85/1045 | |
| 10,081,484 | B2 * | 9/2018 | Pilzecker | B65D 85/1018 | |
| 2010/0252462 | A1 | 10/2010 | Marchetti | | |
| 2011/0147443 | A1 * | 6/2011 | Igo | B65D 75/5838 | 229/117.31 |
| 2011/0303567 | A1 * | 12/2011 | Bray | B65D 75/5838 | 206/265 |
| 2017/0305648 | A1 * | 10/2017 | Park | B65B 19/223 | |
| 2017/0313449 | A1 * | 11/2017 | Fallon | B65B 19/025 | |
| 2017/0334634 | A1 * | 11/2017 | Bray | B65D 85/1045 | |
| 2017/0341852 | A1 * | 11/2017 | Bray | B65D 75/5838 | |

FOREIGN PATENT DOCUMENTS

| | | | |
|---|---|---|---|
| WO | 8700149 | A1 | 1/1987 |
| WO | 2006070771 | A1 | 7/2006 |
| WO | 2008062159 | A1 | 5/2008 |
| WO | 2013120913 | A1 | 8/2013 |
| WO | 2014013478 | A1 | 1/2014 |
| WO | 20140134478 | A1 | 1/2014 |

OTHER PUBLICATIONS

International Preliminary Report on Patentability for corresponding application PCT/GB2015/053637 filed Nov. 27, 2015; Report dated Dec. 15, 2016.

International Search Report for corresponding application PCT/GB2015/053637 filed Nov. 27, 2015; dated Feb. 11, 2016.

Written Opinion of the International Search Authority for corresponding application PCT/GB2015/053637 filed Nov. 27, 2015; dated Feb. 11, 2016.

Written Opinion of the International Preliminary Examining Authority for corresponding application PCT/GB2015/053637 filed Nov. 27, 2015; Report dated Nov. 2, 2016.

* cited by examiner

WRAPPER FOR TOBACCO INDUSTRY PRODUCTS

TECHNICAL FIELD

The present invention relates to a wrapper for a group of tobacco industry products, particularly but not exclusively to a wrapper for packaging cigarettes.

BACKGROUND

Cigarette packs are known to have a reclosable label that is provided on a wrapped bundle of cigarettes. Pulling the label exposes an extraction opening for retrieving the cigarettes. The label includes a region of pressure sensitive adhesive that allows the label to be repositioned over the extraction opening and held in place.

SUMMARY

In accordance with embodiments of the invention, there is provided a wrapper for a group of tobacco industry products, the wrapper comprising a barrier material arranged to extend over an edge of a bundle after the barrier material is wrapped around a group of tobacco industry products to form said bundle, a tab being arranged such that pulling the tab forms an extraction opening that extends over said edge of said bundle, and wherein, prior to pulling the tab for the first time, at least a part of the barrier material is unbroken across said edge.

At least a part of the barrier material may be unbroken in an edge region adjacent to said edge prior to pulling the tab away from the barrier material for the first time.

The edge region may extend onto each adjacent face of said edge.

The wrapper may comprise a label attached to the barrier material. The label may comprise the tab.

The label may extend over said edge of the barrier material.

A section of the barrier material adhered to the label may separate from the remainder of the barrier material to form the extraction opening in the barrier material when the label is pulled.

The label may be larger than the section of the barrier material that separates from the remainder of the barrier material to form the extraction opening, such that the label can re-cover the extraction opening and a part of the label overlaps the remainder of the barrier material at least partially around the extraction opening.

The part of the label that overlaps the remainder of the barrier material at least partially around the extraction opening may comprise pressure sensitive adhesive such that the label can be reattached to the barrier material at least partially around the extraction opening.

The unbroken part of the barrier material may be arranged to tear on pulling the tab for the first time.

The barrier material may comprise a laminate having two or more layers, at least one of said layers being unbroken across said edge of the barrier material.

At least one of the layers of the barrier material may be weakened to define a tear path through the barrier material for forming the extraction opening.

The barrier material may comprise three or more layers.

At least two layers of the barrier material may be weakened to define a tear path through the barrier material for forming the extraction opening.

The unbroken part of the barrier material which extends across said edge of the barrier material may comprise a polymer having fibres orientated in the direction of the tear.

The barrier material may comprise a starting cut arranged so that, on pulling the tab, tears propagate from the starting cut through the barrier material to form the extraction opening.

The starting cut may be sealably covered by a label prior to pulling the tab for the first time.

The label that covers the starting cut may comprise the tab.

According to a further aspect of the invention, there is provided a bundle comprising the wrapper described above which has been wrapped around a group of tobacco industry products.

Edges of barrier material may be sealably attached to each other. For example, edges of barrier material may be fin sealed to each other.

In one example, the bundle may have at least a partial vacuum therein. In another example, the bundle may have an increased pressure therein.

Additionally or alternatively, the bundle may have a modified atmosphere therein.

The bundle may further comprise a frame surrounding the group of tobacco industry products and within the barrier material.

According to a further aspect of the invention, there is also provided a pack comprising a base, a hingedly attached lid, and the bundle of tobacco industry products described above received in the base.

In some embodiments, the tab may be attached to an inside surface of the lid such that opening the lid simultaneously pulls the tab to form the extraction opening.

BRIEF DESCRIPTION OF THE DRAWINGS

Embodiments of the invention will now be described, by way example only, with reference to the accompanying drawings, in which.

DETAILED DESCRIPTION

Figure 1:
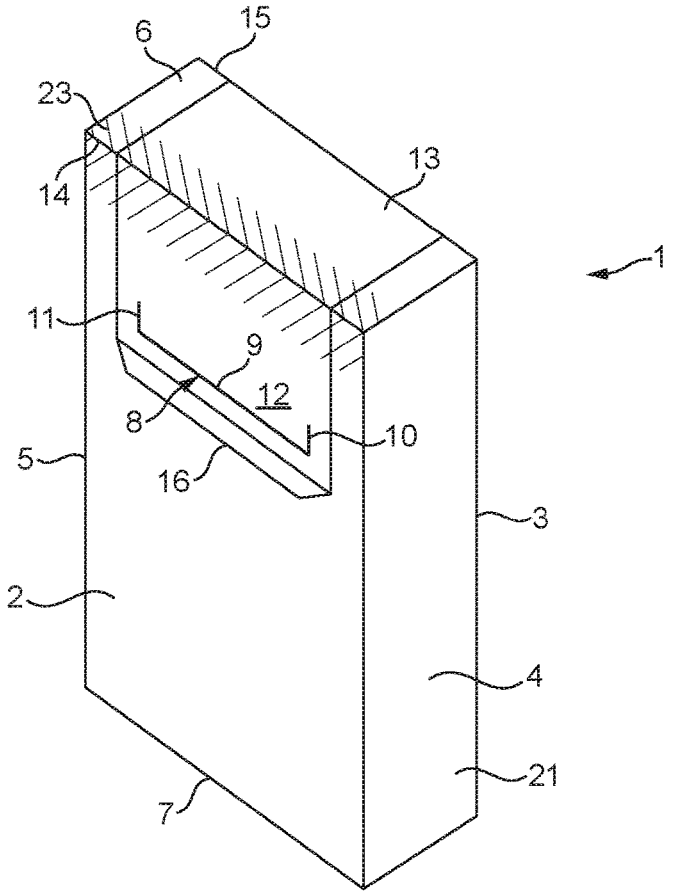
FIG. 1 shows a wrapped bundle of tobacco industry products.

FIG. 1 shows a wrapped bundle of tobacco industry products 1, for example smoking articles. In this example, the tobacco industry products are cigarettes.

The wrapped bundle 1 comprises a flexible barrier material 21 that has been wrapped around a group of cigarettes, for example 20 cigarettes. However, it will be appreciated that the wrapped bundle 1 may contain any number of cigarettes, for example 10 or 14 cigarettes. The cigarettes are elongate cylindrical articles and are arranged in rows such that the overall shape of the wrapped bundle 1 is substantially cuboid, or parallelepiped.

The wrapped bundle 1 comprises a front face 2, a rear face 3, opposing side faces 4, 5 and opposing end faces 6, 7. The wrapped bundle 1 shown in the accompanying drawings have square edges, but it will be appreciated that the edges may be rounded or otherwise shaped according to the shape of the contents of the wrapped bundle 1.

As shown in FIG. 1, the wrapped bundle 1 is provided with a starting cut 8 in the barrier material 21. The barrier material 21 is at least partially cut through in a 'U' shape on the front face 2 of the wrapped bundle 1. The starting cut 8 comprises a first cut line 9 extending across the wrapped bundle 1, in a direction between the opposing side faces 4, 5, and second and third cut lines 10, 11 extending from the ends of the first cut line 9 towards an end face 6 of the wrapped bundle 1. Therefore, the starting cut 8 defines a tab of material 12 enclosed by the first, second and third cuts 9, 10, 11.

It will be appreciated that the starting cut 8 may comprise other shapes. For example, the starting cut 8 may be a single curved cut shaped such that the ends of that cut are directed towards the end face 6 of the wrapped bundle 1.

An adhesive label 13 is adhered to the outside of the wrapped bundle 1 such that it covers and seals the starting cut 8.

The adhesive label 13 shown in FIG. 1 extends from the front face 2 of the wrapped bundle 1, over a front end edge 14 of the wrapped bundle 1, and onto the end face 6 of the wrapped bundle 1. The adhesive label 13 may also extend over a rear end edge 15 of the wrapped bundle 1 onto the rear face 3 of the wrapped bundle 1, as shown in FIG. 1.

Also shown in FIG. 1, the adhesive label 13 comprises a pull tab 16. When a user pulls the pull tab 16 of the adhesive label 13 in a direction away from the front face 2 of the wrapped bundle 1 the adhesive label 13 peels off the front face 2 of the wrapped bundle 1 and pulls on the tab of material 12 formed by the starting cut 8.

As the tab of material 12 is pulled, tears propagate through the barrier material 21, starting from the ends of the second and third cuts 10, 11 and propagating in the direction of the second and third cuts 10, 11, towards the end face 6 of the wrapped bundle 1. As the pull tab 16 is pulled the tears propagate in the front face 2 of the barrier material 21, over the front end edge 14 of the wrapped bundle 1 and across the end face 6 of the wrapped bundle 1.

Depending on the arrangement and extent of the adhesive label 13, and how far the user pulls the pull tab 16, the tears may propagate to a point on the end face 6 of the wrapped bundle 1, or to the rear end edge 15 of the wrapped bundle 1, or over the rear end edge 15 and onto the rear face 3 of the wrapped bundle 1.

Figure 2:
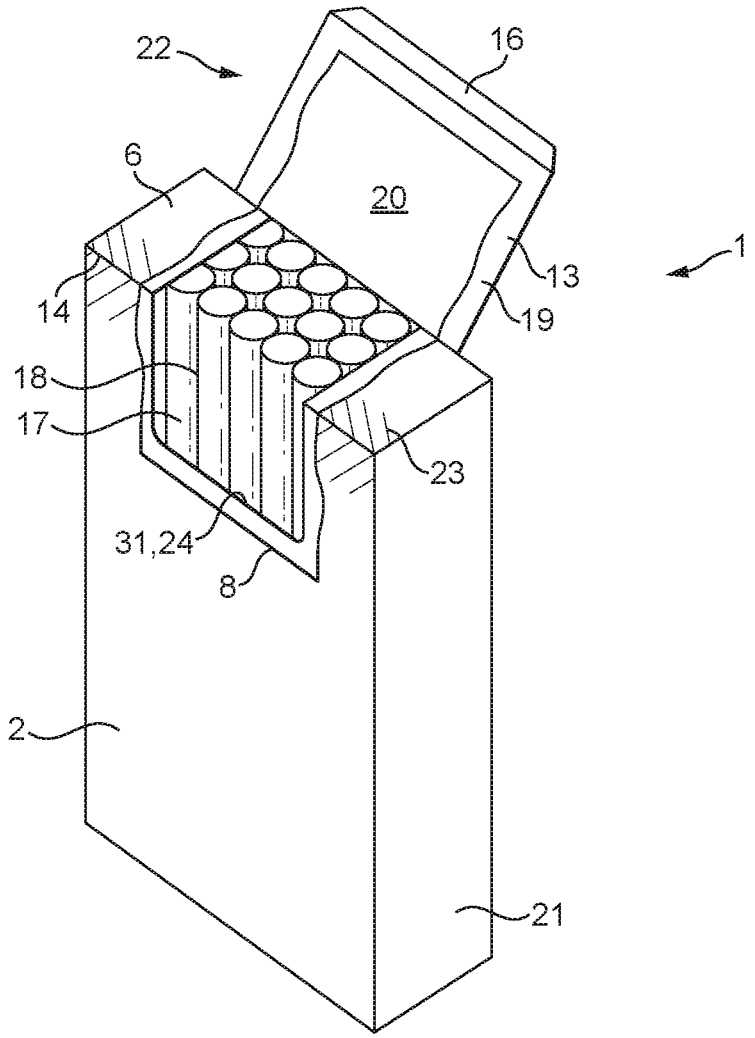
FIG. 2 shows an opened wrapped bundle of tobacco industry products.

The above described pulling of the adhesive label 13 and tearing of the barrier material 21 creates an extraction opening 17, as shown in FIG. 2. The extraction opening 17 extends from the front face 2, over the front end edge 14 and into the end face 6 of the wrapped bundle 1. The cigarettes 18 can be removed from the wrapped bundle 1 via the extraction opening 17 when the adhesive label 16 is in the lifted position.

In an alternative embodiment, the starting cut 8 comprises a line of weakness, and not a through cut as described above. In this way, pulling the pull tab 16 will cause the barrier material 21 to tear along the line of weakness and thereby create a starting cut, from which the barrier material 21 will tear and the extraction opening 17 is formed.

In another alternative embodiment, the barrier material 21 is not provided with any cut or weakening to form a starting cut as described above. In this example, the adhesive label 13 can be permanently adhered to selected regions of the barrier material 21 so that on pulling the adhesive label 13 the barrier material 21 is subjected to a shear force in some locations that causes the barrier material 21 to tear in a predetermined shape.

The adhesive label 13 may be adhered to the wrapped bundle 1 at least partially with pressure sensitive adhesive.

As shown in FIG. 1 and FIG. 2, the edges of the adhesive label 13 are offset from the cut lines 9, 10, 11 of the starting cut 8 and are therefore offset from the edges of the extraction opening 17 in the barrier material 21 after first opening of the wrapped bundle 1.

Therefore, the label 13 comprises an overlapping region 19 that surrounds the extraction opening 17. This overlapping region 19 of the adhesive label 13 may be provided with pressure sensitive adhesive so that the adhesive label 13 can be repositioned over the extraction opening 17 and the pressure sensitive adhesive will re-adhere to the barrier material 21 and hold the adhesive label 13 in place over the extraction opening 17.

The adhesive label 13 may be provided entirely with pressure sensitive adhesive, or may include a region of permanent adhesive in addition to the pressure sensitive adhesive in the overlapping region 19.

The torn section 20 of the barrier material 21, which has been separated from the wrapped bundle 1 to form the extraction opening 17, remains adhered to the adhesive label 13 as shown in FIG. 2.

The torn section 20 may be attached to the adhesive label 13 by pressure sensitive adhesive, or by a region of permanent adhesive provided between the torn section 20 and the adhesive label 13. If the torn section 20 is attached to the adhesive label 13 by pressure sensitive adhesive then the pressure sensitive adhesive may have an increased coating weight in the region of the torn section 20 to prevent the torn section 20 from detaching from the adhesive label 13 during use.

Therefore, the adhesive label 13 and the torn section 20 of the barrier material 21 form a re-usable cover flap 22 for closing the extraction opening 17 after first opening. The pressure sensitive adhesive on the overlapping region 19 of the adhesive label 13 is used to reattach the cover flap 22 and the barrier material 21.

In another embodiment, the adhesive label 13 is provided with one-use adhesive in the overlapping region 19, so that the cover flap 22 can be repositioned over the extraction opening 17 but the adhesive label 13 will not be re-adhered to the barrier material 21.

A part of the adhesive label 13 may be permanently adhered to the barrier material 21, so that the cover flap 22 is retained on the wrapped bundle 1 and can not be completely removed. In other embodiments, the cover flap 22 may be removed completely from the wrapped bundle 1 on opening, by using one-use adhesive over the whole of the adhesive label 13, and/or by providing a tear-off line through the adhesive label 13.

As shown in FIG. 1, prior to first opening of the wrapped bundle 1 the barrier material 21 in the region of the front end edge 14 of the wrapped bundle 1 is intact. That is, the barrier material 21 is unbroken and is in no way weakened across the front end edge 14 of the barrier material 21, where the extraction opening 17 will be formed. In particular, the barrier material 21 in this region is not cut, perforated, punctured or otherwise weakened in such a way that may reduce the sealing integrity of the barrier material 21 in the region of the front end edge 14.

Therefore, prior to first opening, the barrier material 21 in the region of the front end edge 14 of the wrapped bundle 1 is unbroken so that this region of the barrier material 21 provides a strong and durable seal.

In combination with the adhesive label 13 covering the starting cut 8, the front face 2, end face 6 and rear face 3 of the wrapped bundle 1 are therefore sealably closed prior to first opening by pulling on the pull tab 16.

The starting cut 8 is spaced from the front end edge 14 so that an edge region 23 is defined, extending from the front end edge 14 onto the end face 6 and onto the front face 2 of the wrapped bundle 1. In this edge region 23 the barrier material 21 is at least partially unbroken. The edge region 23 extends across the width of the wrapped bundle 1, between the opposing side faces 4, 5, in the region of the front end edge 14. The edge region 23 may extend at least 5 millimetres onto each of the adjacent faces of the front end edge 14—i.e. the end face 6 and the front face 2 of the wrapped bundle 1.

On the other hand, if the barrier material 21 had a cut or other perforation that extends through the barrier material 21 within the above defined edge region 23, or a cut that extended over the front end edge 14, the deformation caused by folding the barrier material 21 and adhesive label 13 over the front end edge 14 would result in a weaker seal than is provided by the above described arrangement. That is, because the barrier material 21 and adhesive label 13 would be at least partially deformed by folding them over the front end edge 14, the seal provided by the adhesive label 13 would not be strong and durable—over time air would eventually seep through between the adhesive label 13 and the barrier material 21 and enter the wrapped bundle 1 through that cut or perforation in the edge region 23.

The improved seal provided by maintaining an unbroken barrier material 21 in the front edge region 23 of the wrapped bundle 1 will prevent air from entering the wrapped bundle 1 after manufacture and therefore maintain the freshness of the cigarettes 18 for longer.

In another example, if a reduced pressure is provided within the wrapped bundle 1, i.e. a partial vacuum, then the barrier material 21 and adhesive label 13 would be pushed inwards towards the cigarettes 18 by the atmospheric pressure outside of the wrapped bundle 1. In this case, the barrier material 21 may deform to the shape of the contents of the wrapped bundle 1 and this may reduce the effectiveness of the seal provided by the adhesive label 13 over the front edge region 23 of the wrapped bundle 1.

Maintaining the integrity of the barrier material 21 in the front edge region 23 prevents any deformation in the barrier material 21 from affecting the seal provided, which helps to maintain the pressure differential for a longer period of time.

In each of the examples described above, the wrapped bundle 1, despite the stronger and more durable seal, is provided with a convenient means for opening the wrapped bundle 1—the adhesive label 13 which causes the barrier material 21 to tear on first opening to create the extraction opening 17.

The above described sealed front edge of the wrapped bundle is advantageous because it provides for longevity of the seal which is important for maintaining freshness, or if a positive or negative pressure were to be provided within the wrapped bundle. In most cases, it will be many weeks, possibly months, between cigarettes being packaged and first opening by a consumer. During this time, the packs of cigarettes will have been moved from the place of packaging into storage, held in sales displays (or similar) and then might be kept by the consumer for some time before first opening.

Therefore, it is important to provide a strong and durable seal that prevents ingress of air between the adhesive label 13 and the barrier material 21.

Figure 3:
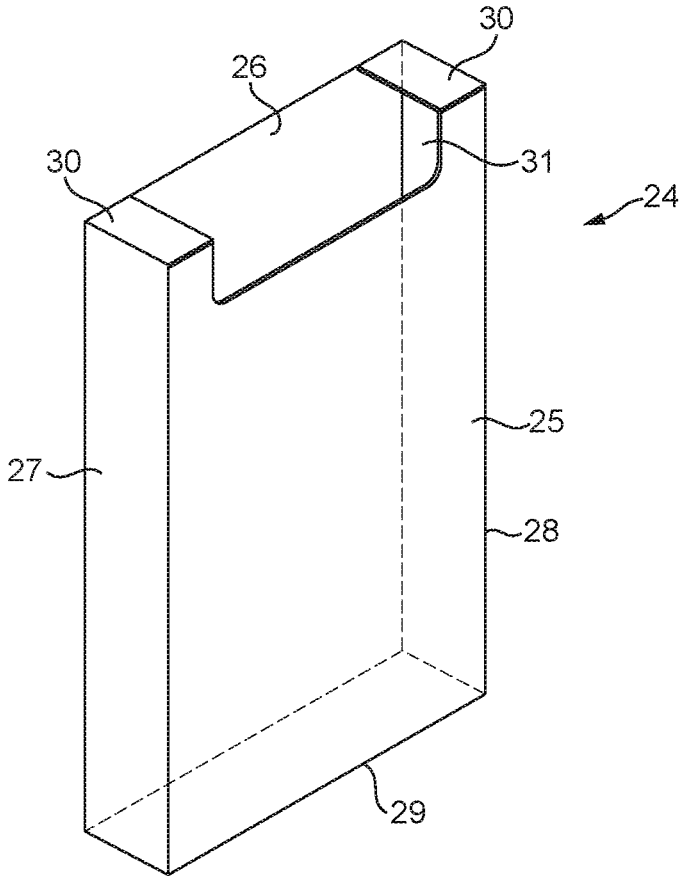
FIG. 3 shows an inner frame for a wrapped bundle of tobacco industry products.

FIG. 3 shows an inner frame 24 that holds the cigarettes 18 (see FIG. 2) and is wrapped by the barrier material 21 to form the wrapped bundle 1 shown in FIGS. 1 and 2. In other words, the inner frame 24 may be positioned between the cigarettes 18 and the barrier material 21.

The inner frame 24 comprises a front wall 25, a rear wall 26, opposing side walls 27, 28, a bottom wall 29 and a top wall 30, that correspond to the front face 2, rear face 3, opposing side faces 4, 5 and end faces 6, 7 of the wrapped bundle 1 once the inner frame 24 is wrapped in the barrier material 21. The inner frame 24 also comprises an aperture 31 formed in the end wall 30 and front wall 25 that is aligned with the above described extraction opening 17 after first opening of the wrapped bundle 1, as shown in FIG. 2.

In this example, the aperture 31 in the inner frame 24 extends partially across the top wall 30 and front wall 25 of the inner frame 24, i.e. across the front edge region 23 of the wrapped bundle 1. Therefore, when the extraction opening 17 is formed it is aligned with the aperture 31 in the inner frame 24.

The inner frame 24 provides additional strength and supports the cigarettes 18. Moreover, if the wrapped bundle 1 is provided with a reduced internal pressure, for example a partial vacuum, then the inner frame 24 helps protect the cigarettes 18 against the crushing force of the atmospheric pressure acting on the outside of the wrapped bundle 1.

In some examples, the aperture 31 in the inner frame 24 is sized and positioned such that, after creating the extraction opening 17 in the barrier material 21 by pulling the adhesive label 13, at least some edges of the aperture 31 lie within the extraction opening 17.

Figure 4:
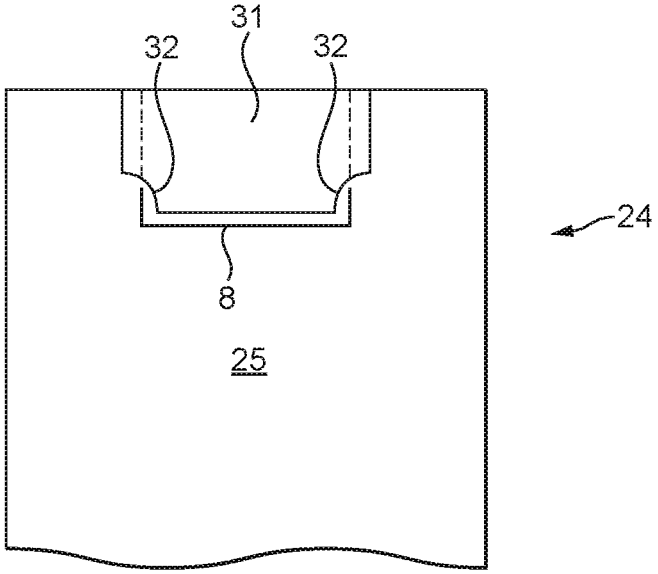
FIG. 4 shows a first example of a profile of the aperture of the inner frame of FIG. 3.

FIG. 4 shows an example of the inner frame 24, viewed from the front wall 25. In this example, the aperture 31 in the inner frame 24 is arranged to support the starting cut 8 formed in the barrier material 21, as shown. In particular, the aperture 31 is formed such that supporting portions 32 of the inner frame 24 lie directly behind the starting cut 8 when the barrier material 21 is wrapped around the inner frame 24.

In this way, when the barrier material 21 is deformed, for example by applying a reduced pressure to the interior of the wrapped bundle 1, the starting cut 8, being pushed towards the inner frame 24 by atmospheric pressure, is supported by the supporting portions 32 of the inner frame 24 and will not bend or deform, meaning that the adhesive label 13 can effectively seal the starting cut 8 and prevent ingress of air between the adhesive label 13 and the barrier material 21.

The flat supporting surface provided by the supporting portions 32 of the inner frame 24 prevents the barrier material 21 from deforming in the region of the starting cut 8, and thereby improves the seal provided before first opening of the wrapped bundle 1 described with reference to FIGS. 1 to 3.

Figure 5:
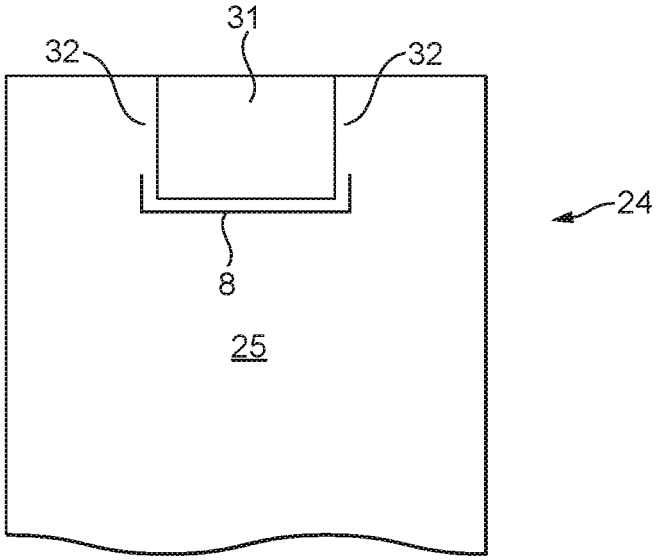
FIG. 5 shows a second example of profile of the aperture of the inner frame of FIG. 3.

In another example, shown in FIG. 5, the aperture 31 of the inner frame 24 is arranged such that the edges of the aperture 31 lie within the boundary of the extraction opening 17 around all of, or the majority of, its periphery. Therefore, as shown in FIG. 5, supporting portions 32 of the inner frame 24 lie directly behind the projected tear lines in the barrier material, which are aligned with the ends of the starting cut 8. This provides increased support for the barrier material 21 in the region of the starting cut 8 prior to first opening of the wrapped bundle 1.

In other examples described hereinafter, the barrier material 21 is provided with lines of weakness 33 that define the tear lines that form the extraction opening 17 in the wrapped bundle 1. In these examples, prior to first opening, at least a part of the barrier material 21 is unbroken in the front edge region 23 in which the extraction opening 17 will be formed. Therefore, the sealing integrity of the barrier material 21, and of the wrapped bundle 1, is not reduced, while a convenient opening mechanism is provided by the adhesive label 13 and starting cut 8.

The lines of weakness 33 provide a path-of-least-resistance that the tears will follow as they propagate through the barrier material 21 to form the extraction opening 17.

Figure 6:
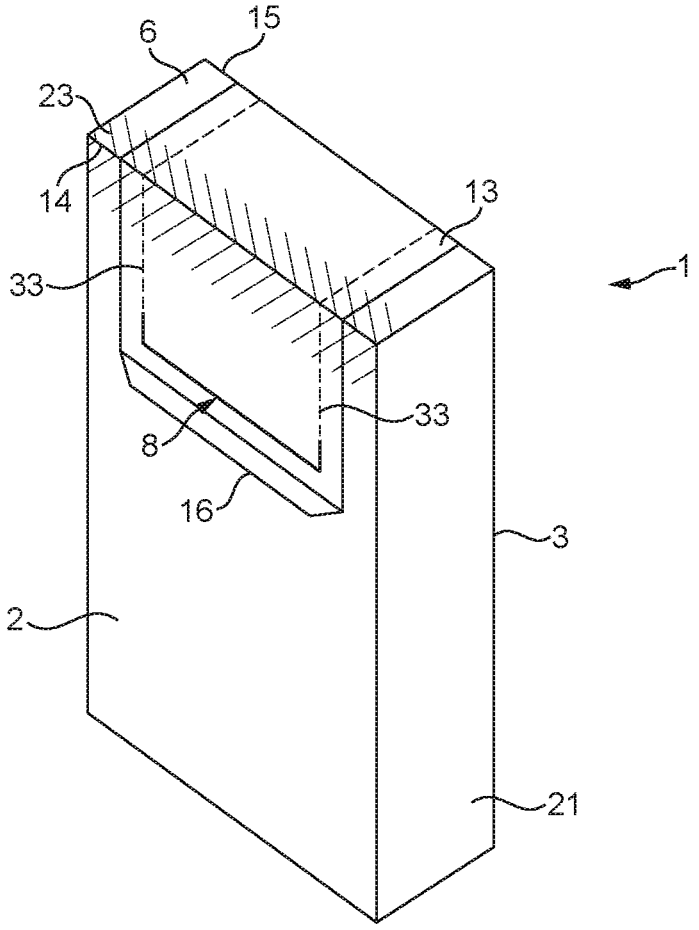
FIG. 6 shows a wrapped bundle of tobacco industry products, having lines of weakness.

As shown in FIG. 6, lines of weakness 33 extend from the ends of the starting cut 8 in a direction towards the end face 6, over the front end edge 14, and onto the end face 6 of the wrapped bundle 1. Therefore, as the adhesive label 13 is pulled from the barrier material 21 tears will propagate from the starting cut 8 along the lines of weakness 33 to form an extraction opening 17 similar to that shown in FIG. 2.

The lines of weakness 33 mean that a user need apply less force to the adhesive label 13 to form the extraction opening 17, and the tears are neater and straighter, resulting in a more uniform extraction opening 17.

The barrier material 21 may comprise a single layer of material. Alternatively, the barrier material 21 may comprise a laminate material of two or more layers, for example three layers. Each layer of the barrier material 21 may comprise a polymer (for example polypropylene), a metal foil, a metallised film (for example a metallised polymer film) or other flexible material suitable for packaging.

In some examples, the barrier material 21 is a single layer of material. In this case, the lines of weakness 33 in the barrier material may be formed by partially reducing the thickness of the barrier material 21 along a line. The barrier material 21 may be cut or scored along a line.

For example, a partial cut may extend through between 20% and 80% of the thickness of the barrier material 21 to weaken the barrier material 21 along that cut line. Alternatively, the barrier material 21 may be de-bossed along a line to reduce the thickness of the barrier material 21 along that line by between 20% and 80%. This reduced thickness provides the line of weakness 33 along which the barrier material 21 will tear when a user applies a force by pulling on the adhesive label 13.

In each case, the remaining unbroken portion of the barrier material 21 is sufficient to provide the seal in the front edge region 23 of the wrapped bundle 1, to prevent air from entering the wrapped bundle 1 between the adhesive label 13 and the barrier material 21.

In other examples, the barrier material 21 is a laminate of two or more layers. In this case, at least one of the layers of the barrier material 21 remains at least partially unbroken to provide the seal in the front edge region 23 of the wrapped bundle 1.

For example, for a two-ply laminate barrier material 21, one of the layers can be partially or fully reduced in thickness to provide a line of weakness 33. The second layer of the barrier material 21 may also be partially reduced in thickness, but maintains an unbroken portion across the front edge region 23.

In examples where the barrier material 21 comprises two or more layers, the outermost layers of the barrier material 21 may be reduced in thickness from opposite sides of the barrier material 21. Alternatively, the above described weakening may be performed from one side of the barrier material 21.

In a further example, the barrier material comprises a three-ply laminate material. In this case, the two outermost layers may be fully or partially reduced in thickness, for example by cutting, scoring or de-bossing. In this case, at least a portion of the middle layer remains unbroken across the front edge region 23 of the wrapped bundle 1.

Alternatively, the three-ply laminate may be cut, scored or de-bossed from one side of the barrier material 21, into two of the layers of the laminate. In this case, at least a portion of the outermost layer on the opposite side of the barrier material 21 remains unbroken across the front edge region 23 of the wrapped bundle 1.

In a preferred embodiment, the barrier material 21 comprises a laminate having three layers—outer layers of orientated polypropylene and a middle layer of metal foil, for example aluminium foil.

The barrier material, or more specifically the layer(s) of the barrier material, may be cut by mechanical means, for example a rotary cutter having a fixed blade depth. Alternatively, the barrier material 21 may be cut using lasers with a preselected power and/or wavelength so that the laser cuts through only the desired parts of the layers of the barrier material.

In alternative embodiments, the lines of weakness 33 may not be formed in the front edge region 23 of the wrapped bundle 1. For example, the lines of weakness 33 may extend from the starting cut 8 towards the end face 6 of the wrapped bundle 1, but not through the front edge region 23 of the wrapped bundle 1.

Lines of weakness 33 may additionally or alternatively be formed in the end face 6 of the wrapped bundle 1, but not in the front edge region 23 of the wrapped bundle 1.

In each of the above described embodiments, at least a portion of the barrier material remains unbroken across the front edge region 23 of the wrapped bundle 1. In this way, the lines of weakness 33 do not reduce the integrity of the seal in the front edge region 23 of the wrapped bundle 1.

FIGS. 7A to 13 show various examples of a barrier material 21 prior to being wrapped about the group of cigarettes 18, and optionally the inner frame 24, to form a wrapped bundle 1. In these examples, the starting cuts 8 and lines of weakness 33 can be formed in any of the ways described above. In particular, the starting cuts 8 and lines of weakness 33 can be formed by mechanical cutting, laser cutting, scoring, de-bossing, or any other suitable means of cutting or weakening the barrier material 21 along a line.

Figure 7A:
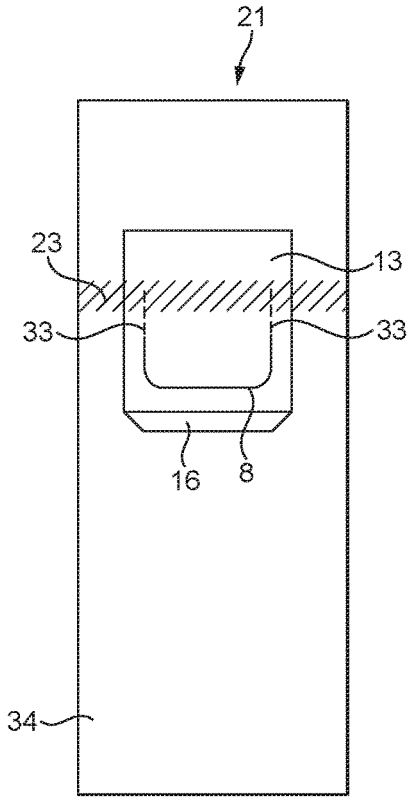
FIGS. 7A and 7B show an example of a barrier material for forming a wrapped bundle of tobacco industry products.
Figure 7B:
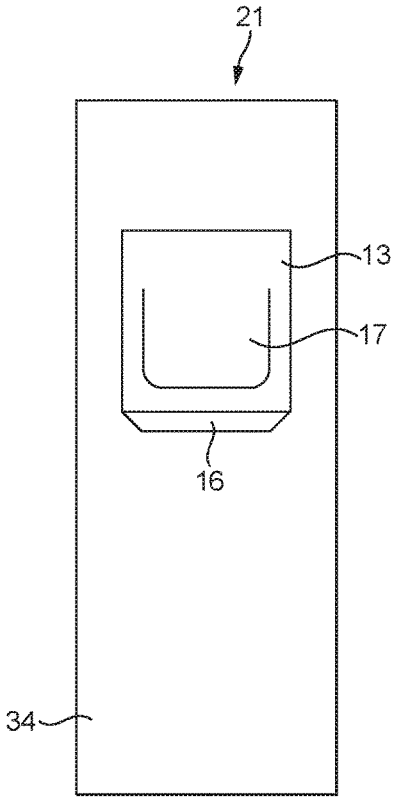

FIGS. 7A and 7B show a first example of a barrier material 21. The barrier material 21 comprises a body portion 34 that is wrapped about a group of cigarettes 18 as previously described. FIGS. 7A and 7B also show the adhesive label 13 with pull tab 16 that is applied to the barrier material 21, as described with reference to FIGS. 1 and 2.

FIG. 7A shows the barrier material 21 before the wrapped bundle 1 has been opened for the first time, i.e. before the extraction opening 17 has been formed. As shown, the starting cut 8 is provided and lines of weakness 33 extend from the ends of the starting cut 8.

FIG. 7B shows the barrier material 21 after the wrapped bundle 1 has been opened, where the barrier material 21 has been torn along the lines of weakness 33 to form the extraction opening 17.

In this example, as explained above, the barrier material 21 may comprise one or more layers and the starting cut 8 and lines of weakness 33 are arranged so that at least a portion of the barrier material 21 remains unbroken across the front edge region 23 of the wrapped bundle 1 when the barrier material 21 has been wrapped around a group of cigarettes 18 as shown in FIGS. 1 and 2. The front edge region 23 is indicated in FIG. 7A.

In one example, the barrier material 21 comprises three layers, and the innermost layer is provided with a line of weakening to guide the tears through the other layers of the barrier material 21 as the adhesive label 13 is pulled.

Figure 8A:
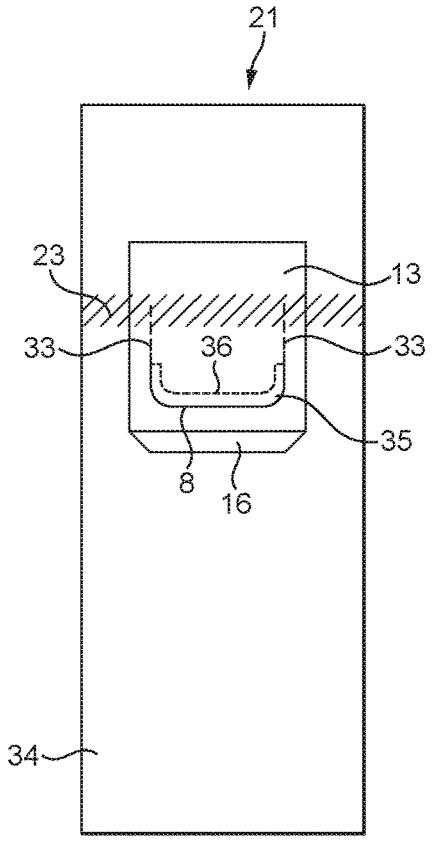
FIGS. 8A and 8B show another example of a barrier material for forming a wrapped bundle of tobacco industry products.
Figure 8B:
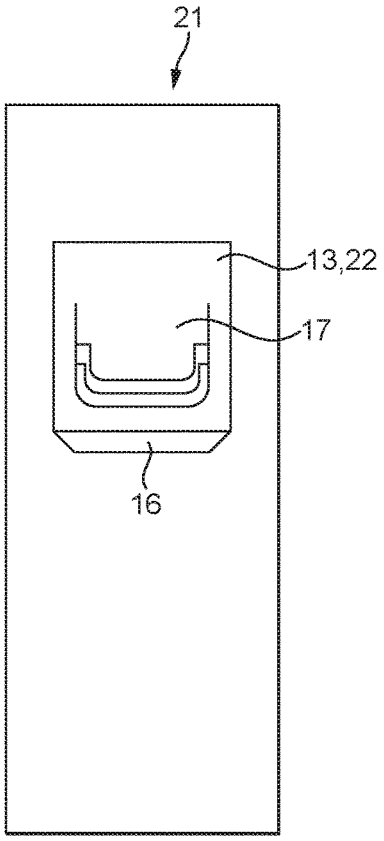

FIGS. 8A and 8B show a second example of the barrier material 21 for wrapping around a group of cigarettes 18 and optionally an inner frame 24 to form a wrapped bundle 1 as described with reference to FIGS. 1 and 2.

In this example, as shown in FIG. 8A, prior to first opening the barrier material 21 is provided with a starting cut 8 and lines of weakness 33 extending from the ends of the starting cut 8, similar to the embodiments described with reference to FIG. 7A.

However, in this example, the barrier material 21 is a laminate comprising at least two layers. Moreover, pressure sensitive adhesive is provided between these two layers in at least one region 35 of the barrier material 21, as described hereinafter.

In this example, the starting cut 8 is formed by cutting through at least the outermost layer of the barrier material 21, but not the innermost layer.

Lines of weakness 33 in at least the innermost layer, but not the outermost layer, extend from the ends of the starting cut 8.

Moreover, a further cut line 36 is provided in the innermost layer of the barrier material 21 and is offset from the starting cut 8 to delimit an overlapping region 35 between the starting cut 8 and the further cut line 36. This further cut line 36 intersects the lines of weakness 33 in the innermost layer at the ends of the starting cut 8.

Pressure sensitive adhesive may be provided between the innermost and outermost layers of the barrier material 21 in at least this overlapping region 35.

As shown in FIG. 8B, when the pull tab 16 on the adhesive label 13 is pulled and the layers of the barrier material 21 are delaminated (i.e. separated) in the overlapping region 35 and then the barrier material 21 is torn along the lines of weakness 33 to form the extraction opening 17.

In this way, the overlapping region 35 is delaminated and the pressure sensitive adhesive between the innermost and outermost layers of the barrier material 21 in the overlapping region 35 can be used to reattach the layers of the barrier material 21 on closing the cover flap 22.

Therefore, the cover flap 22 can be repositioned over the extraction opening 17 after first opening to re-close the extraction opening 17. In this example, the pressure sensitive adhesive in the overlapping region 35 and the pressure sensitive adhesive on the adhesive label 13 can both be used to re-close the extraction opening 17.

In other examples, the overlapping region 35 is provided with a single-use adhesive and the adhesive label 13 is provided with pressure sensitive adhesive. Therefore, only the adhesive label 13 will be reattached to the barrier material 21 on closing the cover flap 22.

Similarly to previously described examples, in the examples described with reference to FIGS. 8A and 8B, at least a portion of the barrier material is unbroken across the front edge region 23 of the wrapped bundle 1 prior to first opening. In this case, the outer layer of the barrier material 21 is unbroken across the front edge region 23.

Figure 9:
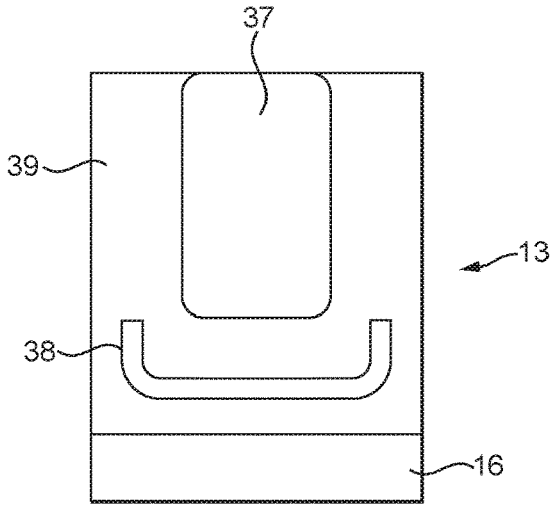
FIG. 9 shows an example of an adhesive pattern on the adhesive labels of FIG. 7A, 7B, 8A or 8B.

FIG. 9 shows an example of the arrangement of adhesive applied between the adhesive label 13 and the barrier material 21 for the embodiments described with reference to FIGS. 7A to 8B. FIG. 9 shows the underside of the adhesive label 13.

The arrangement of adhesive described below relates to the adhesive on the underside of the adhesive label 13, and not to any adhesive provided between layers of the barrier material 21. As previously described, the barrier material 21 may be provided with pressure sensitive and/or permanent adhesive between the layers of the barrier material 21.

As shown in FIG. 9, the pull tab 16 is not provided with any adhesive, so that a user can easily lift and grasp the pull tab 16 for opening the wrapped bundle 1. Alternatively, the adhesive on the pull tab 16 may be neutralised.

A first area 37 of the adhesive label 13 is provided with permanent adhesive. This first area 37 is disposed between the adhesive label 13 and the barrier material 21 that corresponds approximately to the torn section (20, see FIG. 2) of the barrier material 21 that is torn away from the wrapped bundle 1 to form the extraction opening (17, see FIG. 2). The permanent adhesive means that the torn section 22 remains attached to the adhesive label 13 to form the cover flap (22, see FIG. 2).

The remaining area 39 between the adhesive label 13 and the barrier material 21 is provided with a pressure sensitive adhesive. In this way, the adhesive label 13 can be repositioned over the extraction opening 17 and re-adhere to the barrier material 21 around the edges of the extraction opening 17, as previously explained. It will be appreciated that parts of the remaining area may be covered by parts of the torn section 22 of barrier material.

Optionally, the adhesive label may further include a second area 38, which is provided with single-use adhesive between the adhesive label 13 and the barrier material 21 that corresponds approximately to the area surrounding the starting cut (8, see FIGS. 7A and 8A for example).

The second area 38 of single-use adhesive overlaps the starting cut 8 and provides a gasket or seal over the starting cut 8 prior to first opening of the wrapped bundle 1, to increase the strength of the seal. The second area 38 of single-use adhesive is easily broken by the user on first opening of the wrapped bundle 16, and will not re-adhere when the adhesive label 13 is repositioned over the extraction opening 17.

It will be appreciated that in the above described examples that include a line of weakness 33, 36, the aperture 31 in the inner frame 24 within the wrapped bundle 1 may be shaped to provide support behind the lines of weakness 33, 36, as well as the starting cut 8 as described with reference to FIGS. 4 and 5.

In particular, the aperture 31 of the inner frame 24 may be shaped such that the lines of weakness 33, 36 are supported in the front face 2 of the wrapped bundle 1, but not in the end face 6.

Alternatively, the aperture 31 of the inner frame 24 may be shaped such that the lines of weakness 33 are supported in the end face 6 of the wrapped bundle 1, but not in the front face 2. Alternatively, the aperture 31 of the inner frame 24 may be shaped such that the lines of weakness 33, 36 are supported in both the end face 6 of the wrapped bundle 1 and in the front face 2. In any case, the aperture 31 of the inner frame 24 may be shaped such that the starting cut 8 is supported.

In all of the above described embodiments, the front edge region 23 of the wrapped bundle 1 comprises a barrier material 21 having at least a portion which is unbroken to provide a strong, durable, sealed closure. At the same time, the adhesive label 13, together with other features such as a starting cut 8, or lines of weakening 33, provide a convenient and easy to use way of tearing the barrier material 21 to form an extraction opening 17 to access the cigarettes 18.

As described above, the unbroken portion of the barrier material 21 may be one or more layers of a laminate barrier material, or alternatively an unbroken part of a layer of the barrier material 21, which may comprise only one layer.

The unbroken portion of the front edge region 23 of the wrapped bundle 1 should be made of a material sufficiently strong and resilient to maintain the seal, even when subjected to deformation caused by a pressure differential or deformation of the wrapped bundle 1 caused by a crushing force, for example during storage and transport.

The unbroken portion of the barrier material 21 is preferably a polymer, such as orientated polypropylene.

In this case, the fibres of the polymer material may be orientated and the barrier material 21 arranged such that the fibres are orientated in the direction of the desired tear lines. Therefore, the polymer material will tear more easily and more neatly as the adhesive label 13 is pulled to form the extraction opening 17. Otherwise, the polymer may stretch and deform as it is torn, leaving the extraction opening 17 with uneven edges and the adhesive label 13 may not easily seal over such edges.

As described hereinafter, to form the wrapped bundle 1 the barrier material 21 is wrapped around a group of cigarettes 18 and sealably closed. The cigarettes 18 may first be placed within an inner frame 24 to support and protect the cigarettes 18, and then the barrier material 21 can be wrapped around the inner frame 24 and group of cigarettes 18.

In one example, the edges of the barrier material 21 may be folded against the sides of the contents of the wrapped bundle 1, for example the inner frame 24, to form overlapping flaps that are sealed to each other, for example by using adhesive, heat seal induction sealing, or ultrasonic welding.

Figure 10:
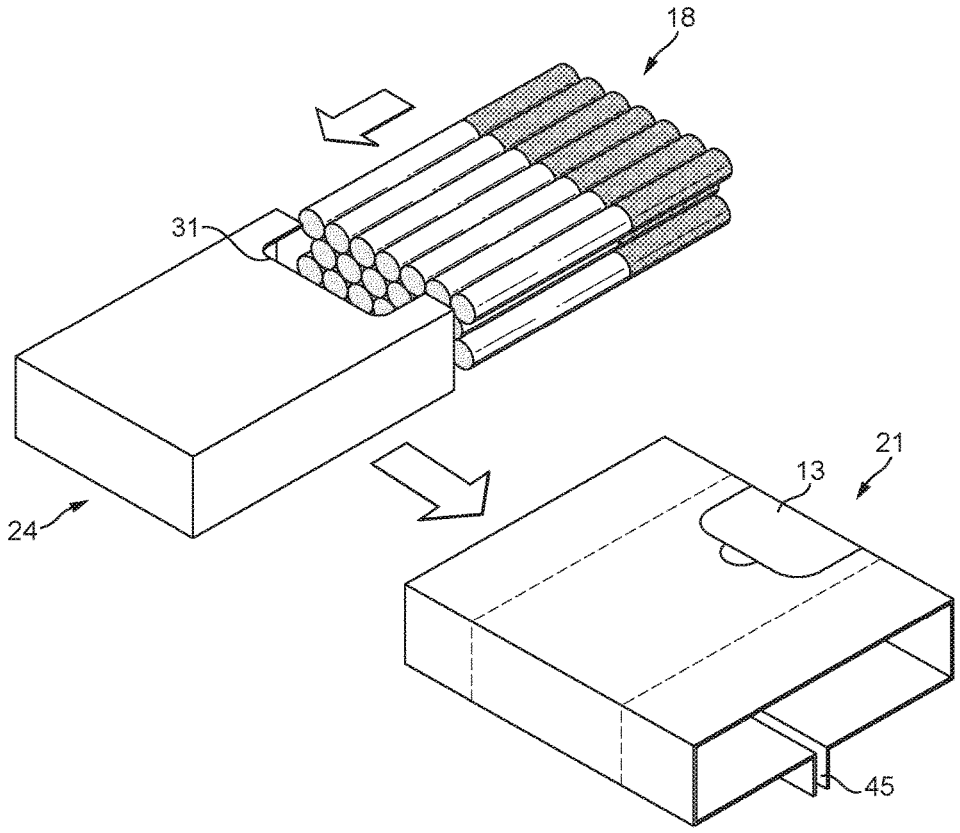
FIG. 10 shows a schematic diagram of a process for making a wrapped bundle of tobacco industry products.

In another example, shown in FIG. 10, the barrier material 21 may be folded around the inner frame 24, and the ends of the barrier material 21 may be fin sealed.

In particular, the cigarettes 18 can be placed into the inner frame 24, for example by folding the inner frame 24 around the group of cigarettes 18, and then the barrier material 21 can be wrapped around the inner frame 24 as shown.

Figure 11:
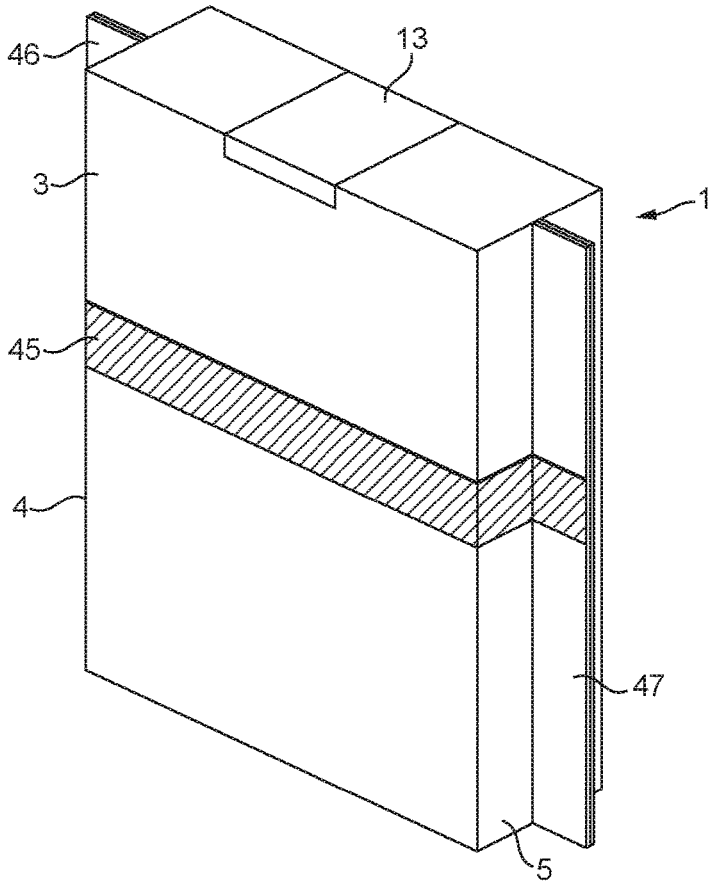
FIG. 11 shows a wrapped bundle of tobacco industry products having fin seals.

Firstly, edges of the barrier material 21 can be fin sealed to each other to form a first fin seal 45 that means the barrier material 21 is tubular around the inner frame 24. Then, the ends of the tubular barrier material 21 can also be fin sealed together, to form second and third fin seals 46, 47, as shown in FIG. 11.

In this example, the fin sealed bundle 1 has the first fin seal 45 extending across the rear face 3 of the wrapped bundle 1, and the second and third fin seals 46, 47 extending along the opposing side faces 4, 5 of the wrapped bundle 1.

Figure 12:
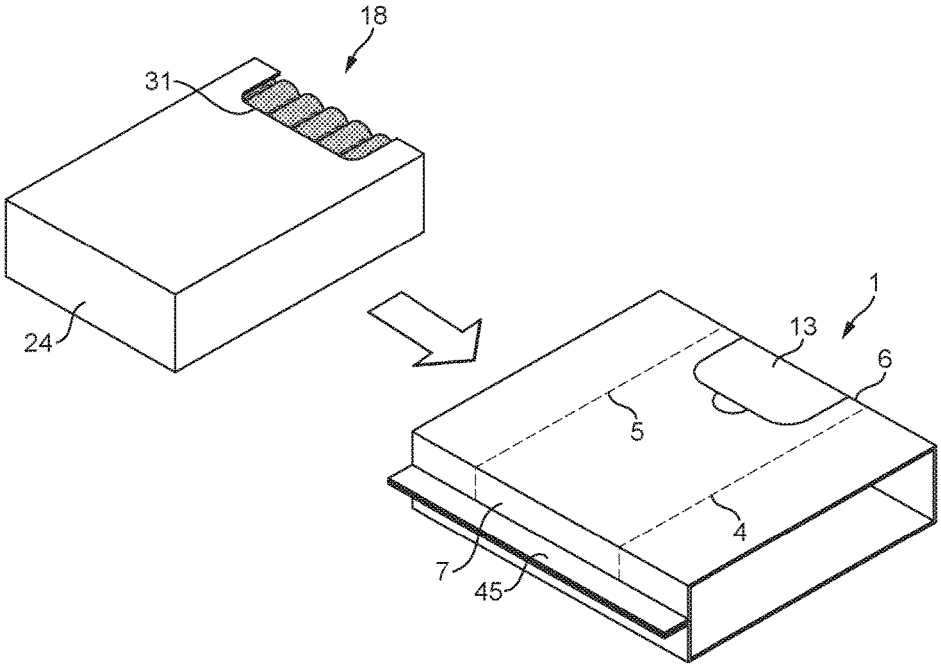
FIG. 12 shows an alternative schematic diagram of a process for making a wrapped bundle of tobacco industry products.

In another example, schematically shown in FIG. 12, the first fin seal 45 may be formed across the end face 7 of the wrapped bundle 1 which is opposite to the end face 6 having the adhesive label 13. The second and third fin seals 46, 47 can then be formed along the opposing side faces 4, 5 of the wrapped bundle 1.

In an alternative example, the first fin seal 45 may be formed across the front face 2 of the wrapped bundle 1, below the adhesive label 13.

As shown in FIG. 11, the fin seals 45, 46, 47 can be folded flat against the faces of the wrapped bundle 1.

A fin seal can be formed by pressing parts of the barrier material 21 together and applying heat and/or adhesive to join those parts of the barrier material 21 together. The heat may melt and/or fuse components of the barrier material 21 together.

A fin sealed wrapped bundle 1, as described above, will provide a strong hermetic seal capable of holding a pressure differential. For example, the interior of the wrapped bundle may be provided with a pressure above or below atmospheric pressure.

An increased pressure within the wrapped bundle 1 can be provided by adding air, or some other gas, or liquid, to the interior of the wrapped bundle 1 prior to forming the final seal. A reduced pressure, for example a partial vacuum, can be provided to the interior of the wrapped bundle 1 by extracting air prior to forming the final seal, for example by carrying out the wrapping and sealing process described with reference to FIG. 10 or FIG. 12 in a low pressure environment.

Alternatively, the wrapped bundle 1 may be provided with a one-way valve adapted to permit flow of air in one direction and not the other. The valve on the wrapped bundle 1 can then be provided with either a high pressure source or a low pressure source to move air into or out of the wrapped bundle 1.

Alternatively, the interior of the wrapped bundle 1 may be provided with a modified atmosphere, for example a gas other than air, for example an inert gas. In one example, the wrapped bundle 1 may be provided with a nitrogen rich atmosphere therein.

Additionally, other substances may be added to the interior of the pack as a liquid and allowed to evaporate within the wrapped bundle 1, for example to increase the pressure within the wrapped bundle 1.

Figure 13:
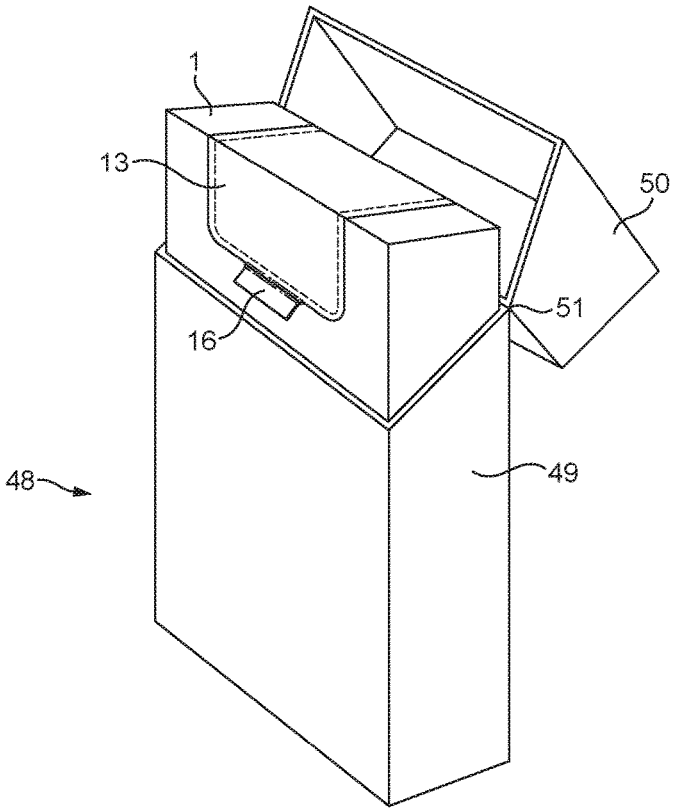
FIG. 13 shows a pack containing the wrapped bundle of tobacco industry products of any previous FIG.

As shown in FIG. 13, the various examples of wrapped bundles 1 described with reference to FIGS. 1 to 12, may be received within a hinged-lid pack 48 to provide a pack of cigarettes.

Alternatively, the wrapped bundle 1 may be provided as packaging itself, without any further pack outer or lid.

As shown in FIG. 13, the hinged-lid pack 48 has a base portion 49 having a parallelepiped form and which is adapted to receive the wrapped bundle 1 such that the wrapped bundle 1 protrudes from the base portion 49. In this position, the adhesive label 13, in particular the pull tab 16, is accessible for opening the wrapped bundle 1 and providing access to the cigarettes within.

A lid 50 is hingedly connected to the base portion 49 about a hinge 51. The lid 50 is pivotable between a closed position, where the lid 50 covers the wrapped bundle 1, and an open position, where the wrapped bundle 1 is exposed. FIG. 13 shows the lid 50 in the open position, such that a user can grasp the pull tab 16 on the adhesive label 13 and pull to tear the barrier material 21 and form the extraction opening 17.

In further embodiments, a part of the adhesive label 13 may be attached to an inside face of the lid 50, such that operation of the lid 50 simultaneously operates the cover flap 22 on the wrapped bundle 1.

In particular, the tab 16 of the adhesive label 13 may be adhered to an inside face of the lid 50 so that when the lid 50 is pivoted about the hinge 51 into its open position, the tab 16 is pulled, thereby lifting the cover flap 22 and forming the extraction opening.

Figure 14:
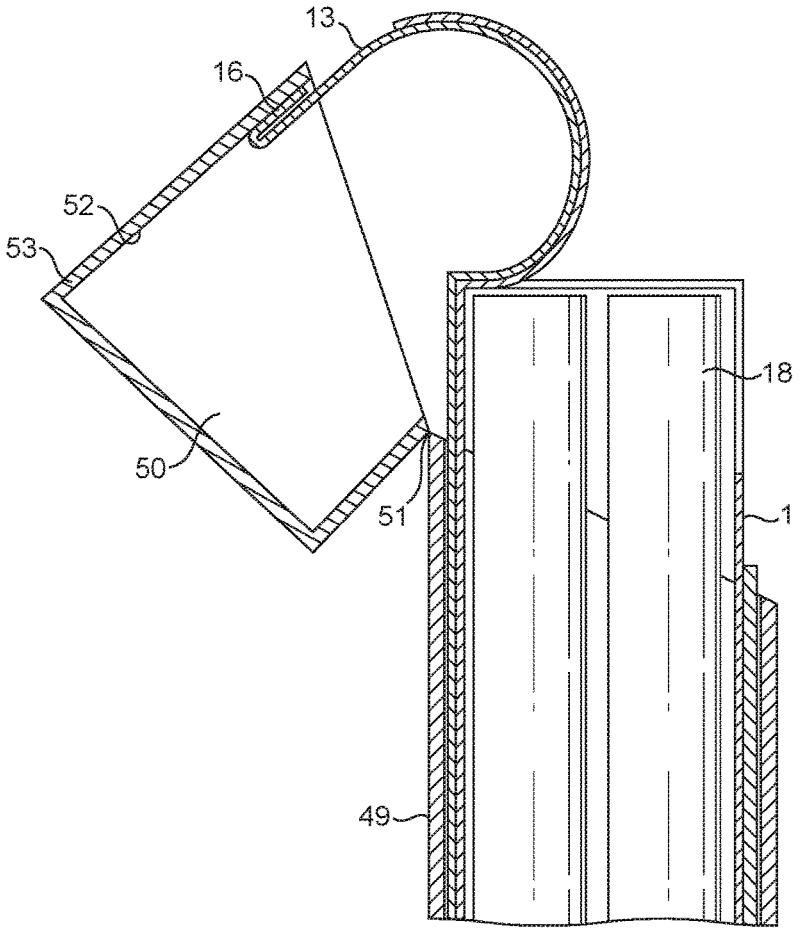
FIG. 14 shows a pack containing the wrapped bundle of tobacco industry products of any of FIGS. 1 to 12, with the tab attached to the lid; and, FIG. 15 shows a second example of a pack containing the wrapped bundle of tobacco industry products of any of FIGS. 1 to 12, with the tab attached to the lid.

The outside surface of the tab 16 may be attached directly to the inside face 52 of the lid front wall 53, as shown in FIG. 14. Alternatively, the tab 16 may be folded back and then attached to the inside face 52 of the lid front wall 53, as shown in FIG. 15.

Figure 15:
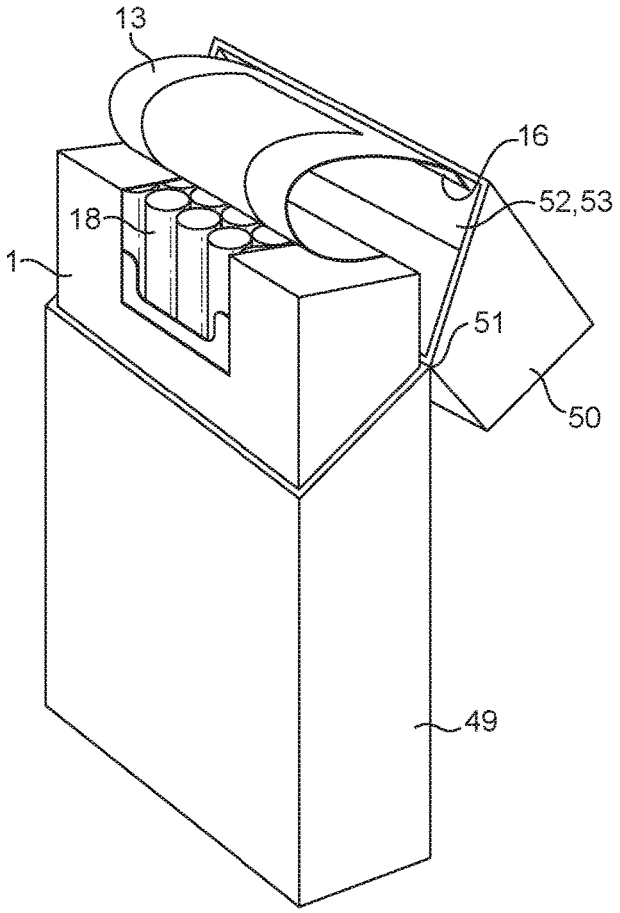

In the embodiments of FIG. 14 and FIG. 15, attaching the pull tab 16 to the lid 50 has the advantage that the adhesive label 13 is pulled evenly and smoothly as the lid 50 is opened for the first time, which can help to control the tears in the barrier material 21. As used herein, the term 'pressure sensitive adhesive' means adhesives that are capable of being reused multiple times. That is, the adhesive is permanently tacky so that two components can be detached and reattached repeatedly.

As used herein, the term 'permanent adhesive' means adhesives that are intended to strongly bond together two components such that they will not separate in normal use.

It will be appreciated that the above described examples of wrapped bundle and packaging may be used to package tobacco industry products other than cigarettes.

A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn products; and c) other nicotine-delivery systems such as inhalers, aerosol generation devices including e-cigarettes, lozenges and gum. This list is not intended to be exclusive, but merely illustrates a range of products which are made and sold in the tobacco industry.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products and other nicotine delivery product such as aerosol generation devices including e-cigarettes. The smoking article may be provided with a filter for the gaseous flow drawn by the smoker.

In order to address various issues and advance the art, the entirety of this disclosure shows by way of illustration various embodiments in which the claimed invention(s) may be practiced and provide for superior wrapped bundle of tobacco industry products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A wrapper for a group of tobacco industry products, the wrapper comprising a barrier material arranged to extend over an edge of a bundle after the barrier material is wrapped around a group of tobacco industry products to form said bundle, wherein the wrapper comprises a label attached to the barrier material such that the label extends over said edge, the label comprising a tab arranged such that pulling the tab forms an extraction opening that extends over said edge of said bundle, wherein the barrier material comprises a starting cut formed from a cut-line or a line of weakness, the starting cut being arranged so that, on pulling the tab for the first time, tears propagate from the starting cut through the barrier material to form the extraction opening, wherein the cut-line or line of weakness does not extend over the edge of the bundle so that the tears propagate from said starting cut over said edge.

2. The wrapper of claim 1, wherein the cut-line or line of weakness does not extend over an edge region, the edge region being adjacent to said edge and extending across the entire width of said edge.

3. The wrapper of claim 2, wherein the edge region extends onto each adjacent face of said edge.

4. The wrapper of claim 1, wherein a section of the barrier material adhered to the label separates from the remainder of the barrier material to form the extraction opening in the barrier material when the label is pulled.

5. The wrapper of claim 4, wherein the label is larger than the section of the barrier material that separates from the remainder of the barrier material to form the extraction opening, such that the label can re-cover the extraction opening and a part of the label overlaps the remainder of the barrier material at least partially around the extraction opening.

6. The wrapper of claim 5, wherein said part of the label that overlaps the remainder of the barrier material at least partially around the extraction opening comprises pressure sensitive adhesive such that the label can be reattached to the barrier material at least partially around the extraction opening.

7. The wrapper of claim 1, wherein the barrier material comprises a laminate having two or more layers, at least one of said layers being unbroken across said entire edge of the barrier material.

8. The wrapper of claim 7, wherein at least one of the layers of the barrier material is weakened to define a tear path through the barrier material for forming the extraction opening.

9. The wrapper of claim 7, wherein the barrier material comprises three or more layers.

10. The wrapper of claim 9, wherein at least two layers of the barrier material are weakened to define a tear path through the barrier material for forming the extraction opening.

11. The wrapper of claim 7, wherein the unbroken part of the barrier material which extends across an entirety of said edge of the barrier material comprises a polymer having fibres orientated in the direction of the tear.

12. The wrapper of claim 1, wherein the starting cut is sealably covered by a label prior to pulling the tab for the first time.

13. The wrapper of claim 12, wherein the label that covers the starting cut comprises the tab.

14. A bundle comprising the wrapper of claim 1 wrapped around a group of tobacco industry products.

15. The bundle of claim 14, wherein edges of barrier material are sealably attached to each other.

16. The bundle of claim 15, wherein edges of barrier material are fin sealed to each other.

17. The bundle of claim 14, wherein the bundle has an increased pressure therein.

18. The bundle of claim 14, wherein the bundle has a modified atmosphere therein.

19. The bundle of claim 14, further comprising a frame surrounding the group of tobacco industry products and within the barrier material.

20. A pack comprising a base, a hingedly attached lid, and the bundle of tobacco industry products of claim 14 received in the base.

21. A pack according to claim 20, wherein the tab is attached to an inside surface of the lid such that operation of the lid simultaneously pulls the tab to form the extraction opening.

22. The bundle of claim 1, wherein the bundle has at least a partial vacuum therein.

* * * * *